United States Patent [19]

Johnston, Jr.

[11] 4,165,552

[45] Aug. 28, 1979

[54] SOOT BLOWER DRIVE MECHANISM

[75] Inventor: Jesse C. Johnston, Jr., Carroll, Ohio

[73] Assignee: Diamond Power Specialty Corporation, Lancaster, Ohio

[21] Appl. No.: 928,586

[22] Filed: Jul. 27, 1978

[51] Int. Cl.[2] ..... F23J 3/02

[52] U.S. Cl. ..... 15/312 R; 15/316 R

[58] Field of Search ..... 15/312 R, 312 A, 316 R, 15/316 A, 317, 318

[56] References Cited

U.S. PATENT DOCUMENTS

| | | | |
|---|---|---|---|
| 2,585,776 | 2/1952 | Hermanek | 15/312 X |
| 2,604,358 | 7/1952 | Richards | 15/317 X |

FOREIGN PATENT DOCUMENTS

| | | | |
|---|---|---|---|
| 203041 | 11/1955 | Australia | 15/316 R |

*Primary Examiner*—Christopher K. Moore
*Attorney, Agent, or Firm*—Harness, Dickey & Pierce

[57] ABSTRACT

The carriage of a retracting soot blower has a driven shaft rotatable to move the carriage along a supporting frame to project and retract a lance tube and to simultaneously rotate the lance tube. The driven shaft is driven from a drive shaft powered by a stationary reversible motor. The driven shaft is connected to the drive shaft by a drum and cable assembly including a double drum assembly on the drive shaft, another double drum assembly on the driven shaft, and an idler pulley at the front of the frame. Upon rotation of the drive shaft in one direction the carriage is moved to project the lance tube by a first cable having its opposite end portions wrapped about and secured to drive and driven drums and an intermediate portion trained over the idler pulley. Upon rotation of the drive shaft in the opposite direction, the carriage is moved to retract the lance tube by a second cable having its opposite end portions wrapped about and secured to drive and driven drums.

The present invention relates to soot blowers of the long retracting type for cleaning the heat exchanging surfaces of boilers by discharging a suitable cleaning fluid against such surfaces, and more particularly to such a soot blower having an improved drive mechanism.

17 Claims, 3 Drawing Figures

FIG. 1.
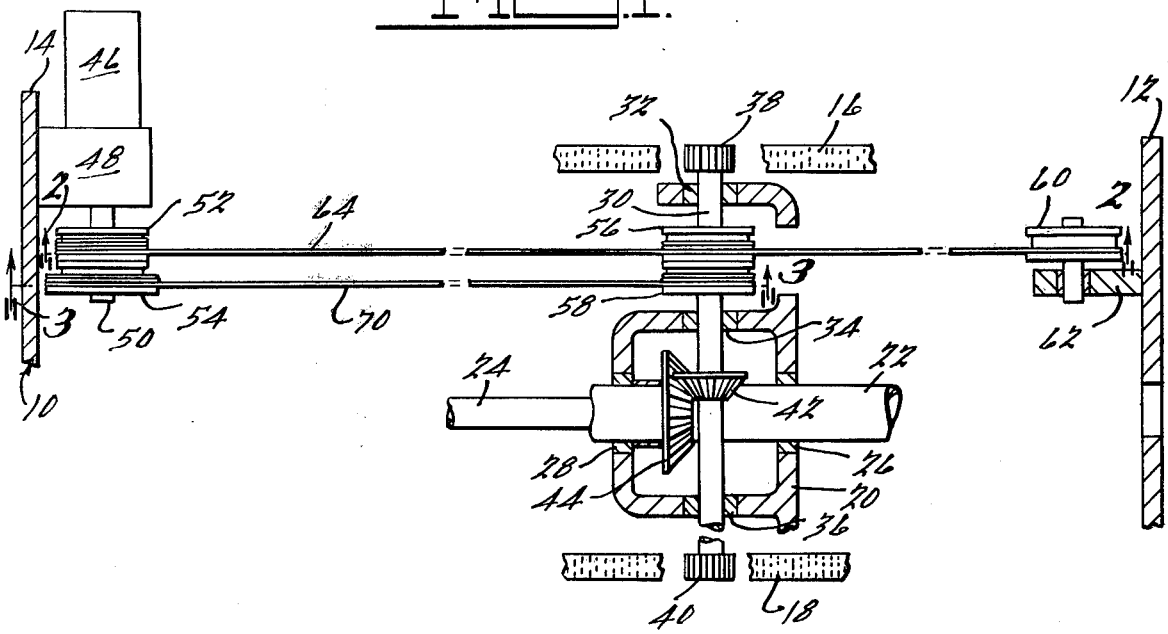
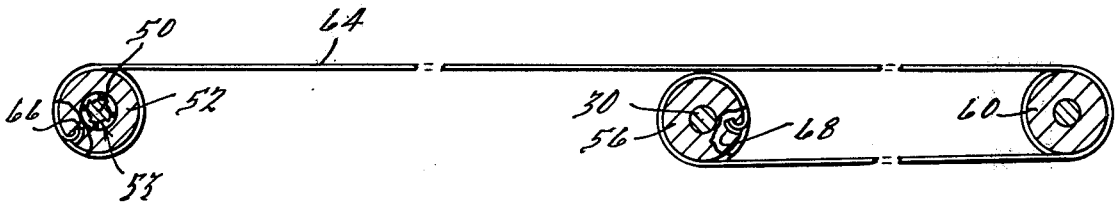
FIG. 2.
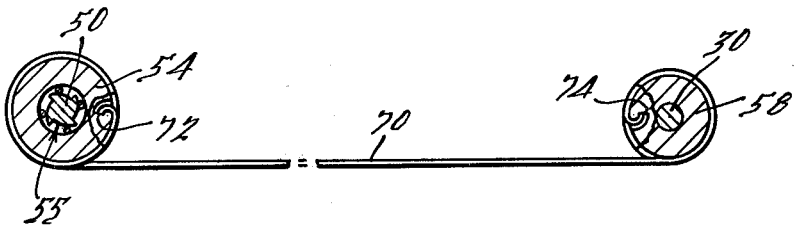
FIG. 3.

SOOT BLOWER DRIVE MECHANISM

BACKGROUND OF THE INVENTION

The long retracting type soot blowers to which the present invention relates are of the type in which a lance tube is telescopically mounted on a feed tube and moves longitudinally between a projected position and a retracted position and rotates about its axis during such movement. In some existing types of soot blowers the lance tube is carried in a carriage and a motor is mounted for movement with the carriage and a flexible power supply is required to accommodate the movement of the motor or motors. In such previously known soot blowers the motor drives through a system of shafts and gears.

The present invention provides a drive system for a long retracting type soot blower in which the carriage carries a driven shaft by means of which the carriage is moved to move the lance tube between projected and retracted positions and by which the lance tube is rotated. A drive shaft is mounted on the soot blower frame adjacent the rear bulkhead thereof and is driven by a reversible motor fixedly mounted on the frame. The driving of the driven shaft from the drive shaft is effected by a double drum and cable assembly including drum portions mounted on the drive and driven shafts for rotation therewith, an idler pulley mounted on the frame, a lance tube-projecting cable arranged to rotate the driven shaft in a direction to move the carriage to project the lance tube in response to operation of the motor to turn the drive shaft in one direction, and a lance tube retracting cable arranged to rotate the driven shaft in a direction to move the carriage to retract the lance tube in response to reverse operation of the motor to turn the drive shaft in the opposite direction.

Although existing types of soot blowers wherein the motor travels with the carriage have important advantages under service conditions which are frequently encountered, there are other service conditions wherein the use of a flexible conductor for the power supply to the motor is undesirable because of possible hazards which arise in event a flexible electric cable is damaged or abraided. An important object of the present invention is to provide an improved drive system which eliminates the need for a flexible power supply, and which incorporates a number of other advantages in addition to compactness, low cost and reliability.

Another object is to provide such an improved soot blower driving system incorporating separate driving means for moving the lance tube forwardly and rearwardly. Thus in event the forward drive system is rendered inoperative due to mechanical failure, such as might occur due to distortion within the boiler if the lance tube should strike a boiler tube, the retracting drive system remains operative to withdraw the lance tube from the boiler.

Another object is to provide such a driving system which is readily adaptable to the provision of different driving speeds for forward and retraction travel, without the necessity of using a two-speed motor or speed control system.

Another object is to provide such a system wherein the length of the cable is not critical, and wherein any changes in length of the cable due to stretching or temperature changes do not affect the operation of the system or result in an undesirable hesitation or dwell at the reversing position. Where a single cable or chain is used, any looseness which develops introduces an aberration in the performance of the system. Such disadvantages are eliminated by the present invention.

Other objects and advantages will be apparent to those skilled in the art upon consideration of the present disclosure in its entirety.

BRIEF DESCRIPTION OF THE DRAWINGS

FIG. 1 is a somewhat diagrammatic broken top plan view showing parts in section of a soot blower embodying the present invention;

FIG. 2 is a cross-sectional view of the forward drive cable system of the structure illustrated in FIG. 1, taken substantially on the line 2—2 thereof; and FIG. 3 is a cross-sectional view of the reverse drive cable system of the structure illustrated in FIG. 1, taken substantially on the line 3—3 thereof.

DESCRIPTION OF THE PREFERRED EMBODIMENT

Referring to the drawing, the soot blower there fragmentarily illustrated includes a supporting frame 10 of which only the front bulkhead 12 and the rear bulkhead 14 are shown. Mounted on the frame 10 are a pair of longitudinal racks 16 and 18 which control the movement of a carriage 20 which is illustrated only fragmentarily.

It will be recognized that the details of the carriage and of the frame structure of the soot blower are subject to variation and are well known in the art. The teeth of the racks 16 and 18 face downwardly and the driving pinions 38–40 mesh with the teeth on the undersides of and roll along the racks, as is also common practice in soot blower construction. The carriage is supported on the frame 10 and movable therealong for projecting and retracting a lance tube 22 carried by the carriage 20 and fitting telescopically over a stationary feed tube 24. The lance tube 22 is mounted in the carriage 20 for movement with the carriage 20 as it moves longitudinally of the lance tube. Also, the lance tube 22 is supported in bearings 26 and 28 in the carriage 20 to accommodate the usual rotation of the lance tube 22 about its axis as it is projected and retracted along the boiler heat transfer surfaces (not shown).

The movement of the carriage 20 to project and retract the lance tube 22 and the rotation of the lance tube 22 during such movement are both effected through a driven shaft 30 which is disposed at right angles to the racks 16 and 18 and the driven shaft 30 is rotatably supported in the housing 20 in aligned bearings 32, 34 and 36. At its opposite ends the driven shaft 30 carries pinion gears 38 and 40 disposed below and meshing with the racks 16 and 18, respectively, for controlling the movement of the carriage in projecting and retracting the lance tube 22. Rotation of the lance tube during such movement is effected through a spiral bevel gear 42 mounted on the driven shaft 30 and meshing with a spiral bevel gear 44 mounted on the lance tube 22.

The driven shaft 30 is driven from a reversible motor 46 mounted on the rear bulkhead acting through reduction gearing indicated at 48 to drive a drive shaft 50. The driven shaft 30 is driven from the drive shaft 50 through a dual drum and cable assembly including a pair of driving drum portions comprising a forward drive drum portion 52 and a reverse or retraction drive drum portion 54, mounted on the drive shaft 50.

In the preferred construction shown, the retraction drum portion 54 is an element separate from and larger than the forward drive drum portion 52. An over-running clutch 53 incorporated in the hub of the drum 52 is arranged to drive the drum 52 when the shaft 50 is driven counterclockwise, as viewed in FIG. 2, and an over-running clutch 55 in the hub of the larger drum 54 is arranged to drive the drum 54 when the shaft 50 is driven in a clockwise direction as viewed in FIG. 3.

A first cable 64 has one end portion wrapped about the drive drum 52 and secured thereto as indicated at 66 and has its opposite end portion wrapped about the driven drum 56 and secured thereto as indicated at 68. An intermediate portion of the cable 64 is trained over the idler pulley 60. This cable 64 is effective upon counterclockwise rotation of shaft 50 by the motor 46 to turn drive shaft 50 in a counterclockwise direction, as viewed in FIG. 2, to drive the driven shaft 30 in a counterclockwise direction and roll pinions 38, 40 forwardly under the racks, thereby moving the carriage 20 to the right as viewed in FIG. 1 to project the lance tube 22.

A second cable 70 has one end portion wrapped about the drive drum 54 and secured thereto as indicated at 72 and has its other end portion wrapped about the driven drum 58 and secured thereto as indicated at 74. This cable 70 is effective upon clockwise rotation of shaft 50 by the reversible motor 46 to drive the driven shaft 30 in a clockwise direction as viewed in FIG. 3 and move the carriage 20 in a direction to retract the lance tube 22, that is, toward the left as viewed in FIG. 1.

It will be recognized that during forward travel of the blower the drum 54 over-runs on the over-running clutch 55, and conversely, during retraction the drum 52 over-runs on the over-running clutch 53. Sufficient friction is incorporated in the over-running clutches to prevent the drums from continuing to over-run when the motor stops. In roller type over-running clutches such as are diagrammatically illustrated in FIGS. 2 and 3, such friction is, as is well known, commonly introduced by the use of springs yieldably urging the rollers toward the wedging position.

It will also be recognized that if the engineer or designer utilizing my invention does not desire to provide differing speeds for forward and retracting movements, all of the driving and driven drums can be of the same size, and the driving drums 52 and 54 can in such event be fast upon the shaft 50. If the drums are the same size, the driving drum portions can of course be a single unit. The driven drum portions are in any event of the same size and fast on shaft 30 and may be constructed as a unit.

While only one preferred embodiment of the invention has been described and illustrated herein, it will be appreciated that various modifications and changes may be made without departing from the spirit and scope of the appended claims.

This description of the preferred embodiments, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. In a retracting soot blower assembly including a lance tube, a support frame and a carriage rotatably supporting said lance tube and movable to move said lance tube to projected and retracted positions, drive means for moving said carriage to move said lance tube between said positions, said drive means including a drive shaft mounted on said frame, and a driven shaft mounted on said carriage, characterized by a pair of drum portions on said drive shaft and drivable thereby, a pair of drum portions on said driven shaft for driving the driven shaft, and an idler pulley mounted on said frame, a first cable operatively engaging selected ones of said drum and so arranged that upon rotation of said drive shaft in one direction said driven shaft will be rotated in a direction to move said carriage to project said lance tube, and a second cable operatively engaging selected ones of said drum portions and so arranged that upon rotation of said drive shaft in the opposite direction said driven shaft will be rotated in a direction to move said carriage to retract said lance tube.

2. A soot blower as defined in claim 1 wherein said frame includes a front bulkhead adapted to be disposed adjacent a boiler setting and a rear bulkhead, said drive shaft being mounted adjacent said rear bulkhead and said idler pulley being mounted adjacent said front bulkhead.

3. A soot blower as defined in claim 2 wherein said first cable has one end portion wrapped about and secured to a first drum portion on said drive shaft, an intermediate portion trained over said idler pulley and its other end portion wrapped about and secured to a first drum portion on said driven shaft.

4. A soot blower as defined in claim 3 wherein said second cable has one end wrapped about and secured to a second drum portion on said drive shaft and its other end wrapped about and secured to a second drum portion on said driven shaft.

5. A soot blower as defined in any of claims 1 to 4, inclusive, including cooperating means mounted on said driven shaft and on said frame for moving said carriage and said lance tube longitudinally of the latter in response to rotation of said driven shaft and other cooperating means on said driven shaft and said lance tube for rotating said lance tube in response to rotation of said driven shaft.

6. A soot blower as defined in claim 5 including a reversible motor mounted on said frame and operatively connected to said drive shaft for driving it in either direction.

7. A soot blower as defined in claim 5 wherein the drum portions of the pair on one of said shafts are of different diameters, and one-way driving clutch means operatively interconnecting each drum portion of said pair of said shaft for driving engagement therewith in opposite angular directions.

8. A soot blower as defined in claim 7 wherein said one-way driving clutch means comprise an overrunning clutch connecting each drum of said pair to said shaft.

9. A soot blower as defined in any of claims 1, 2, 3, or 4 including a reversible motor mounted on said frame and operatively connected to said drive shaft for driving it in either direction.

10. A soot blower as defined in claim 9 including a reversible motor mounted on said frame and operatively connected to said drive shaft for driving it in either direction.

11. A soot blower as defined in claim 9 wherein the drum portions of the pair on one of said shafts are of different diameters, and one-way driving clutch means operatively interconnection each drum portion of said pair to said shaft for driving engagement therewith in opposite angular directions.

12. A soot blower as defined in claim 11 wherein said one-way driving clutch means comprise an overrunning clutch connecting each drum of said pair to said shaft.

13. A drive mechanism for a soot blower having a supporting frame, a lance tube, and a carriage rotatably supporting said lance tube and movable along said frame to extend and retract said lance tube, said drive mechanism comprising a drive shaft mounted on said frame, a driven shaft mounted on said carriage, first cooperating means on said driven shaft and on said frame for moving said carriage along said frame upon rotation of said driven shaft, and second cooperating means on said driven shaft and on said lance tube for rotating said lance tube upon rotation of said driven shaft, characterized by drum and cable means for rotating said driven shaft in one direction in response to rotation of said drive shaft in one direction and for rotating said driven shaft in the opposite direction in response to rotation of said drive shaft in the opposite direction while permitting movement of said driven shaft toward and away from said drive shaft.

14. A soot blower comprising a main frame including a front bulkhead and a rear bulkhead, rack means mounted on said frame between said bulkheads, a feed tube, a lance tube in fluid conductive communication with said feed tube, a carriage mounted on and movable along said frame, said lance tube being mounted on said carriage for movement therewith along said frame and for rotary movement relative to said carriage and about the axis of said lance tube, a driven shaft rotatably mounted on said carriage, pinion means on said driven shaft engaging said rack means for moving said carriage along said frame, cooperating gear means on said driven shaft and said lance tube for effecting rotation of said lance tube relative to said carriage upon rotation of said driven shaft, a motor mounted adjacent said rear bulkhead, and a drive shaft driven by said motor, characterized by first and second drive drum portions mounted on and drivable by said drive shaft, first and second driven drum portions, fast on said driven shaft, an idler pulley mounted on said frame adjacent said front bulkhead, a first cable having one end portion wrapped about and secured to said first drive drum portion, an intermediate portion of said first cable trained over said idler pulley and the other end portion of said first cable wrapped about and secured to said first driven drum portion, a second cable having one end portion wrapped about and secured to said second drive drum portion and the other end portion of said second cable wrapped about and secured to said second driven drum portion whereby operation of said motor to rotate said drive shaft in one direction moves said carriage to project said lance tube and rotates it one direction and operation of said motor to rotate said drive shaft in the opposite direction moves said carriage in the opposite direction to retract said lance tube and rotates it in the opposite direction.

15. A soot blower as defined in any of claims 1, 2, 3, 4 or 14 wherein the drum portions of the pair on one of said shafts are of different diameters.

16. A soot blower as defined in any of claims 1, 2, 3, 4 or 14 wherein the drum portions of the pair on one of said shafts are of different diameters, and one-way driving clutch means operatively interconnecting each drum portion of said pair to said shaft for driving engagement therewith in opposite angular directions.

17. A soot blower as defined in claim 16 wherein said one-way driving clutch means comprise an over-running clutch connecting each drum of said pair to said shaft.

* * * * *

UNITED STATES PATENT AND TRADEMARK OFFICE

CERTIFICATE OF CORRECTION

PATENT NO. : 4,165,552

DATED : August 28, 1979

INVENTOR(S) : Jesse C. Johnston, Jr.

It is certified that error appears in the above-identified patent and that said Letters Patent are hereby corrected as shown below:

Column 4, line 54, "of said" should be --to said--

Signed and Sealed this

*Fourth* Day of *December 1979*

[SEAL]

*Attest:*

SIDNEY A. DIAMOND

*Attesting Officer*

*Commissioner of Patents and Trademarks*